US009741310B2

(12) United States Patent
Pyun et al.

(10) Patent No.: US 9,741,310 B2
(45) Date of Patent: Aug. 22, 2017

(54) METHOD OF DRIVING DISPLAY PANEL AND DISPLAY APPARATUS FOR PERFORMING THE SAME

(71) Applicant: Samsung Display Co., Ltd., Yongin (KR)

(72) Inventors: Ki-Hyun Pyun, Gwangmyeong-si (KR); Jang-Hoon Kwak, Cheonan-si (KR); Hee-Bum Park, Seongnam-si (KR); Jun-Ho Hwang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 149 days.

(21) Appl. No.: 14/632,734

(22) Filed: Feb. 26, 2015

(65) Prior Publication Data

US 2016/0063960 A1 Mar. 3, 2016

(30) Foreign Application Priority Data

Aug. 26, 2014 (KR) ..... 10-2014-0111682

(51) Int. Cl.
*G09G 3/36* (2006.01)

(52) U.S. Cl.
CPC ..... *G09G 3/3677* (2013.01); *G09G 3/3648* (2013.01); *G09G 2310/0245* (2013.01); *G09G 2340/16* (2013.01)

(58) Field of Classification Search
CPC ..... G09G 5/18; G09G 3/3648; G09G 3/3677; G09G 5/10; G09G 2310/0245; G09G 2340/16
See application file for complete search history.

(56) References Cited

U.S. PATENT DOCUMENTS

2011/0122106 A1* 5/2011 Li ..... G09G 3/3648 345/205
2014/0079152 A1 3/2014 Ma et al.

FOREIGN PATENT DOCUMENTS

KR 10-2006-0067291 6/2006
KR 10-2007-0022424 2/2007
KR 10-2009-0012650 2/2009

* cited by examiner

*Primary Examiner* — Sahlu Okebato
(74) *Attorney, Agent, or Firm* — H.C. Park & Associates, PLC

(57) ABSTRACT

A method of driving a display panel includes charging a pixel with first data during a first charging period, comparing a first grayscale of the first data and a second grayscale of second data, charging the pixel with compensated data during a second charging period if the first grayscale is greater than the second grayscale, and charging the pixel with the second data during a third charging period.

15 Claims, 5 Drawing Sheets

METHOD OF DRIVING DISPLAY PANEL AND DISPLAY APPARATUS FOR PERFORMING THE SAME

CROSS-REFERENCE TO RELATED APPLICATION

This application claims priority from and the benefit under 35 U.S.C. §119(a) of Korean Patent Application No. 10-2014-0111682, filed on Aug. 26, 2014, the entire disclosure of is incorporated herein by reference for all purposes.

BACKGROUND

Field

Present disclosure relates to a display device, and more particularly to a method of driving a display panel and a display apparatus for performing the method.

Discussion of the Background

Generally, a liquid crystal display ("LCD") apparatus includes a first substrate including a pixel electrode, a second substrate including a common electrode and a liquid crystal layer disposed between the first and second substrates. An electric field is generated by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel and a panel driver. The display panel includes a plurality of gate lines, a plurality of data lines and a plurality of pixels connected to the gate lines and the data lines. The panel driver includes a gate driver providing gate signals to the gate lines and a data driver providing data voltages to the data lines.

To improve charging rate of the pixels, a preliminary charging method where an N-th gate line is activated before an N-th horizontal period has been employed. In the preliminary charging method, when a grayscale of previous data is much greater than a grayscale of present data, a target pixel represents a higher level of brightness than a desired level of brightness because the target pixel is over-charged.

SUMMARY

Exemplary embodiments of the present inventive concept provide a method of driving a display panel capable of improving display quality.

Exemplary embodiments of the present inventive concept also provide a display apparatus performing the method of driving the display panel.

Additional features of the invention will be set forth in the description which follows, and in part will be apparent from the description, or may be learned by practice of the invention.

Exemplary embodiments of the present invention provide a method of driving a display panel including charging a pixel with first data during a first charging period; comparing a first grayscale of the first data and a second grayscale of second data; charging the pixel with compensated data during a second charging period if the first grayscale is greater than the second grayscale; and charging the pixel with the second data during a third charging period.

Exemplary embodiments of the present invention provide a display panel configure to display an image; a gate driver configured to output a gate-on voltage during a first charging period; and a data driver configured to output a data voltage of compensated data to a pixel during a second charging period if a first grayscale of first data is greater than a second grayscale of second data, and to output a data voltage of the second data to the pixel during a third charging period.

Exemplary embodiments of the present invention provide a display apparatus including a display panel configured to display an image; a gate driver configured to output an adjusted gate voltage having a level lower than a level of a gate-on voltage during a first charging period, and to output the gate-on voltage during a second charging period; and a data driver configured to output a data voltage of previous data to a pixel during the first charging period and the second charging period.

According to the method of driving the display panel and the display apparatus for performing the method, by determining a grayscale of present data or a level of a gate voltage based on a difference between a grayscale of previous data and the grayscale of the present data, a ghost effect due to a pre-charging method may be solved or alleviated.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
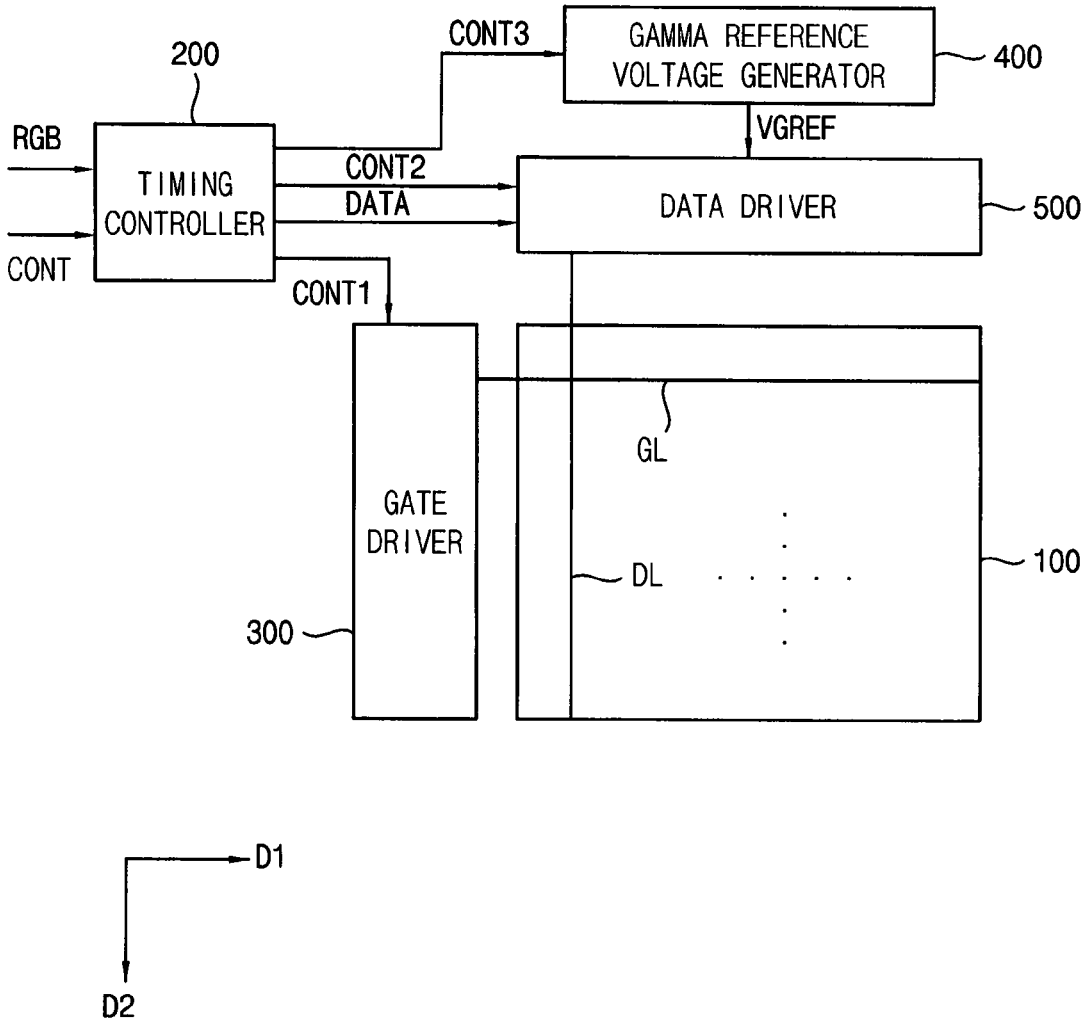
FIG. 1 is a block diagram illustrating a display apparatus according to exemplary embodiments of the present invention.

The invention is described more fully hereinafter with reference to the accompanying drawings, in which embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Although some features may be described with respect to individual exemplary embodiments, aspects need not be limited thereto such that features from one or more exemplary embodiments may be combinable with other features from one or more exemplary embodiments.

FIG. 1 is a block diagram illustrating a display apparatus according to exemplary embodiments of the present invention.

Referring to FIG. 1, the display apparatus includes a display panel 100 and a panel driver. The panel driver includes a timing controller 200, a gate driver 300, a gamma reference voltage generator 400, and a data driver 500.

The display panel 100 includes a display region for displaying an image and a peripheral region adjacent to the display region.

The display panel 100 includes a plurality of gate lines GL, a plurality of data lines DL and a plurality of sub-pixels connected to the gate lines GL and the data lines DL. The gate lines GL extend in a first direction D1 and the data lines DL extend in a second direction D2 crossing the first direction D1.

The sub-pixels include a switching element (not shown), a liquid crystal capacitor (not shown) and a storage capacitor (not shown). The liquid crystal capacitor and the storage capacitor are electrically connected to the switching element. The sub-pixels may be arranged in a matrix configuration.

The timing controller 200 receives input image data RGB and an input control signal CONT from an external device (not shown). The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 may generate the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 may generate the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 may include a data signal generator, a data storage and a data comparing part.

The data signal generator of the timing controller 200 may generate a data signal DATA based on the input image data RGB. The data signal generator may output the data signal DATA to the data driver 500.

The timing controller 200 may generate the third control signal CONT3 for controlling operation of the gamma reference voltage generator 400 based on the input control signal CONT, and outputs the third control signal CONT3 to the gamma reference voltage generator 400.

The gate driver 300 may generate gate signals for driving the gate lines GL in response to the first control signal CONT1 received from the timing controller 200. The gate driver 300 may sequentially output the gate signals to the gate lines GL.

According to aspects of the invention, the gate driver 300 may be directly mounted on the display panel 100, or may be connected to the display panel 100 as a tape carrier package (TCP) type. Alternatively, the gate driver 300 may be integrated on the peripheral region of the display panel 100.

The gamma reference voltage generator 400 may generate a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF may correspond to grayscales of a plurality of pixel data included in the data signal DATA.

According to aspects of the invention, the gamma reference voltage generator may be disposed in the timing controller 200, or may be disposed in the data driver 500.

The data driver 500 receives the second control signal CONT2 and the data signal DATA from the timing controller 200, and receives the gamma reference voltage VGREF from the gamma reference voltage generator 400. The data driver 500 may convert the data signal DATA to data voltages having analogue levels based on the gamma reference voltage VGREF. The data driver 500 may output the data voltages to the data lines DL.

According to aspects of the invention, the data driver 500 may be directly mounted on the display panel 100, or may be connected to the display panel 100 as a tape carrier package (TCP) type. Alternatively, the data driver 500 may be integrated on the peripheral region of the display panel 100.

Figure 2:
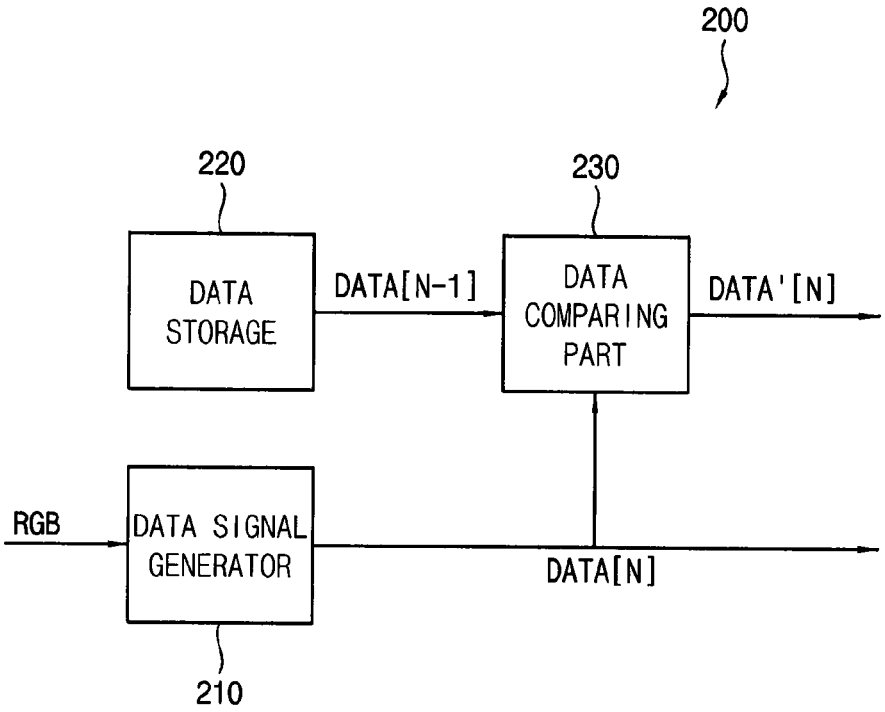
FIG. 2 is a block diagram illustrating a timing controller according to exemplary embodiments of the present invention.

FIG. 2 is a block diagram illustrating a timing controller according to exemplary embodiments of the present invention. Although the timing controller of FIG. 2 is described with respect to the display apparatus of FIG. 1 and its components, aspects of the invention are not limited thereto.

Referring to FIGS. 1 and 2, the timing controller 200 includes the data signal generator 210, the data storage 220 and the data comparing part 230.

The data signal generator 210 may generate the data signal DATA, which may be outputted by the timing controller 200, based on the input image data RGB. The data signal DATA may include previous data DATA[N−1] and present data DATA[N]. The data signal generator 210 may output the previous data DATA[N−1] to the data storage 220. The data signal generator 210 may output the present data DATA[N] to the data driver 500. The data signal generator 210 outputs the present data DATA[N] to the data comparing part 230.

The data storage 220 may store the previous data DATA [N−1] received from the data signal generator 210. The data storage 220 outputs the previous data DATA[N−1] to the data comparing part 230.

The data comparing part 230 may compare a grayscale of the previous data DATA[N−1] received from the data storage 220 with a grayscale of the present data DATA[N] received from the data signal generator 210. The data comparing part 230 may identify or determine whether the grayscale of the previous data DATA[N−1] is greater than the grayscale of the present data DATA[N]. The data comparing part 230 may calculate a difference between the grayscale of the previous data DATA[N−1] and the grayscale of the present data DATA[N]. The data comparing part 230 may compare the difference with a reference grayscale. The reference grayscale may be a grayscale, such as a middle gray scale, between a maximum grayscale and a minimum grayscale. For example, the reference grayscale may be a 128 grayscale.

The data comparing part 230 may determine a grayscale of compensated data DATA'[N] based on the difference between the grayscale of the previous data DATA[N−1] and the grayscale of the present data DATA[N]. The grayscale of the compensated data DATA'[N] may be smaller than the grayscale of the present data DATA[N], when the grayscale of the previous data DATA[N−1] is greater than the grayscale of the present data DATA[N] and when the difference between the grayscale of the previous data DATA[N−1] and the grayscale of the present data DATA[N] is greater than the reference grayscale. The reference grayscale may be a grayscale, for example, the middle grayscale, between the maximum grayscale and the minimum grayscale. The reference grayscale may, for example, be the 128 grayscale. A difference between the grayscale of the compensated data DATA'[N] and the grayscale of the present data DATA[N] may increase as the difference between the grayscale of the previous data DATA[N−1] and the grayscale of the present data DATA[N] increases, when the grayscale of the previous data DATA[N−1] is greater than the grayscale of the present data DATA[N].

The data comparing part 230 may output the compensated data DATA'[N] to the data driver 500.

The data driver 500 receives the second control signal CONT2 and the data signal DATA from the timing controller 200, and receives the gamma reference voltage VGREF from the gamma reference voltage generator 400. The data driver 500 may convert the data signal DATA to the data voltages having the analogue levels based on using the gamma reference voltage VGREF. The data driver 500 may output the data voltages to the data lines DL. The data driver 500 may output a data voltage of the compensated data DATA'[N] to the data line DL during a first charging period. The data driver 500 may output a data voltage of the present data DATA[N] to the data line DL during a second charging period.

Figure 3:
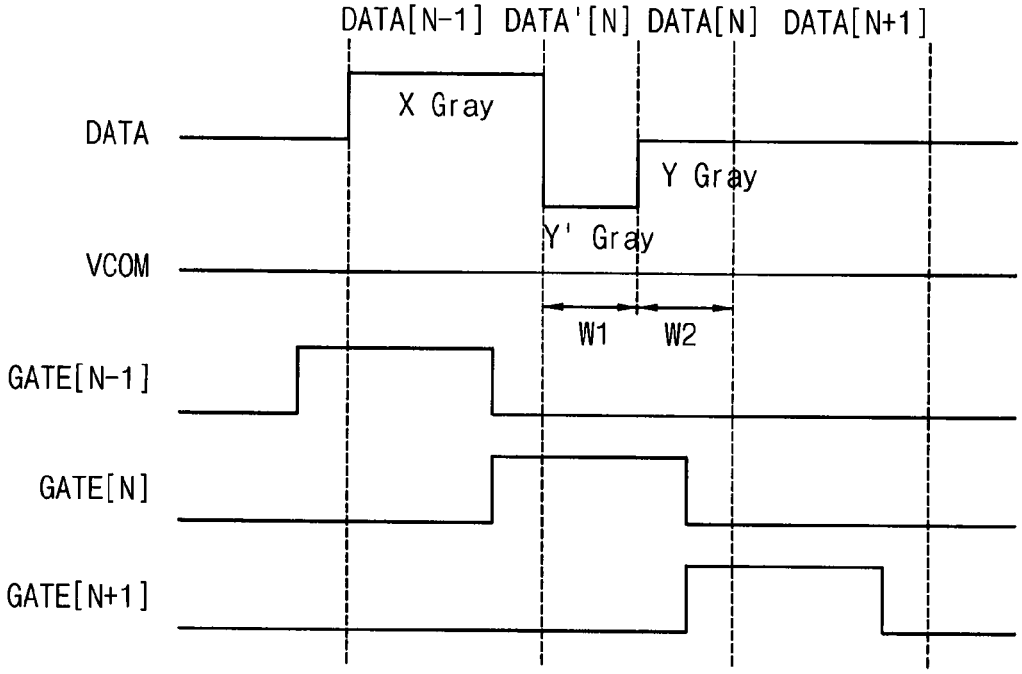
FIG. 3 is a timing diagram illustrating a data signal and a gate signal in FIG. 1.

FIG. 3 is a timing diagram illustrating a data signal and a gate signal in FIG. 1.

Referring to FIGS. 1, 2 and 3, the data signal generator 210 may generate the previous data DATA[N−1] and/or the present data DATA[N] based on the input image signal RGB. The grayscale of the previous data DATA[N−1] may be a Y grayscale. The grayscale of the present data DATA[N] may be a X grayscale. The data signal generator 210 may output the previous data DATA[N−1] to the data storage 220. The data signal generator 210 outputs the present data DATA[N] to the data comparing part 230.

The data storage 220 may store the previous data DATA [N−1]. The data storage 220 outputs the previous data DATA[N−1] to the data comparing part 230.

The data comparing part 230 may compare the grayscale of the previous data DATA[N−1] received from the data storage 220 with the grayscale of the present data DATA[N] received from the data signal generator 210. The data comparing part 230 may identify or determine whether the grayscale of the previous data DATA[N−1] is greater than the grayscale of the present data DATA[N]. The data comparing part 230 may measure the difference between grayscale of the previous data DATA[N−1] received from the data storage 220 and the grayscale of the present data DATA[N] received from the data signal generator 210. The data comparing part 230 may compare the difference with a reference grayscale. The reference grayscale may be a grayscale, for example, the middle grayscale, between the maximum grayscale and the minimum grayscale. The reference grayscale may, for example, be a 128 grayscale.

The data comparing part 230 may determine the grayscale of the compensated data DATA'[N] based on the difference between the grayscale of the previous data DATA[N−1] and the grayscale of the present data DATA[N]. The grayscale of the compensated data DATA'[N] may be smaller than the grayscale of the present data DATA[N], when the grayscale of the previous data DATA[N−1] is greater than the grayscale of the present data DATA[N]. The grayscale of the compensated data DATA'[N] may be smaller than the grayscale of the present data DATA[N], when the grayscale of the previous data DATA[N−1] is greater than the grayscale of the present data DATA[N] and when the difference between the grayscale of the previous data DATA[N−1] and the grayscale of the present data DATA[N] is greater than the reference grayscale. The reference grayscale may be a grayscale, for example, the middle grayscale, between the maximum grayscale and the minimum grayscale. The reference grayscale may, for example, be a 128 grayscale. The difference between the grayscale of the compensated data DATA'[N] and the grayscale of the present data DATA[N] may increase as the difference between the grayscale of the previous data DATA[N−1] and the grayscale of the present data DATA[N] is increased, when the grayscale of the previous data DATA[N−1] is greater than the grayscale of the present data DATA[N].

For example, the grayscale X of the previous data DATA [N−1] may be greater than the grayscale Y of the present data DATA[N]. In this case, the data comparing part 230 may calculate the difference between the grayscale X and the grayscale Y. The data comparing part 230 may compare the difference with the reference grayscale. The reference grayscale may be a grayscale, for example, a middle grayscale, of the maximum grayscale and the minimum grayscale. The reference grayscale may, for example, be a 128 grayscale. The data comparing part 230 may determine the grayscale of the compensated data DATA'[N]. A grayscale Y' of the compensated data DATA'[N] may be smaller than the grayscale Y of the present data DATA[N]. The difference between the grayscale Y' of the compensated data DATA'[N]

and the grayscale Y of the present data DATA[N] may increase as the difference between the grayscale X of the previous data DATA[N−1] and the grayscale Y of the present data DATA[N] increases.

The data comparing part 230 may output the compensated data DATA'[N] to the data driver 500.

The data driver 500 may output the data voltage to the data line DL based on the present data DATA[N] and the compensated data DATA'[N]. The data driver 500 may output the data voltage of the compensated data DATA'[N] to the data line DL during a first charging period W1. The data driver 500 may output the data voltage of the present data DATA[N] to the data line DL during a second charging period W2. For example, the first charging period W1 may be a ¼ H(H: a horizontal period). In another example, the first charging period W1 may be a ½ H. For still another example, the first charging period W1 may be a ¾ H. A horizontal period may include the first charging period W1 and the second charging period W2. According to aspects of the invention, the length of the first charging period W1 may be substantially similar or the same as the length of the second charging period W2.

According to exemplary embodiments, when the grayscale of the previous data is much greater than the grayscale of the present data, the ghost effect based on pre-charging method can be alleviated or solved by charging the compensated data having the smaller grayscale than the grayscale of the present data during the first charging period.

Figure 4:
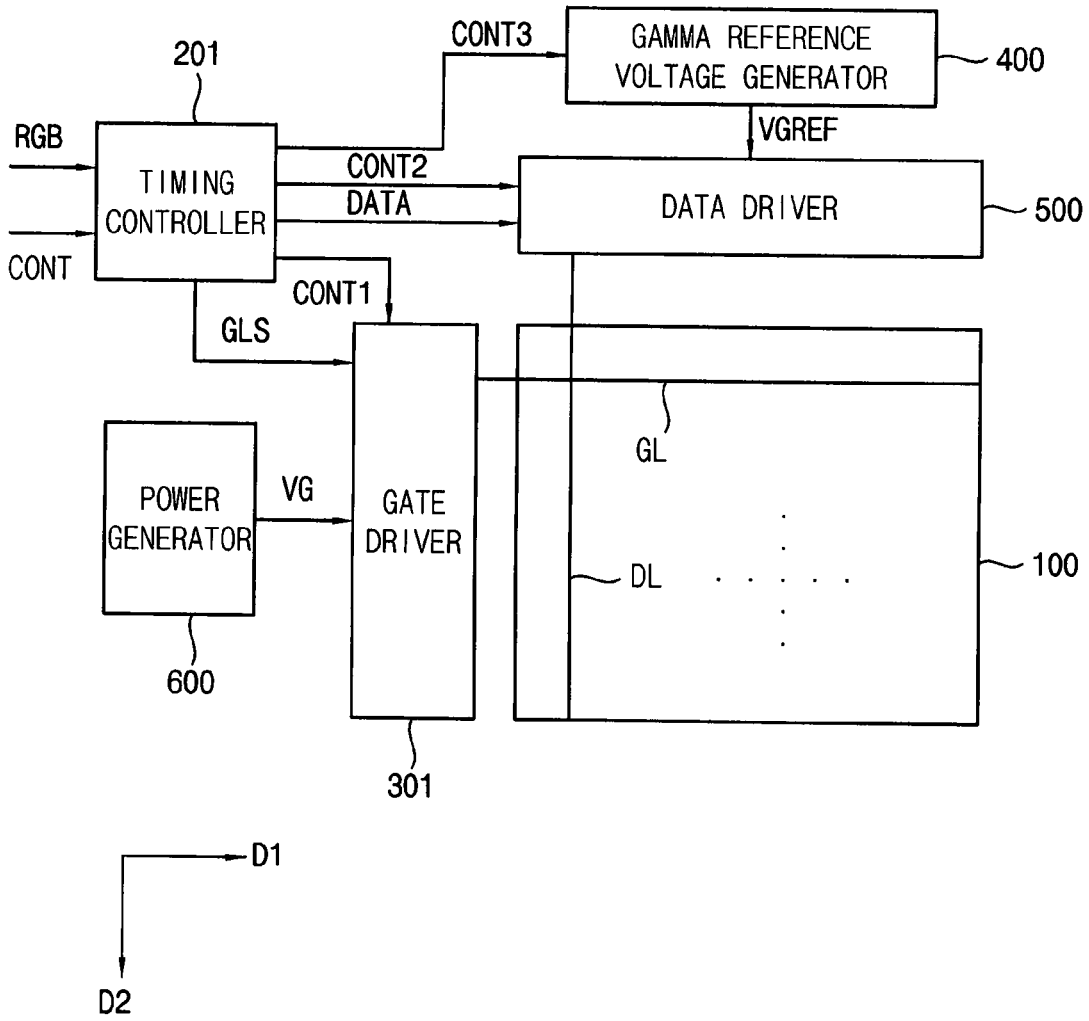
FIG. 4 is a block diagram illustrating a display apparatus according to exemplary embodiments of the present invention.

FIG. 4 is a block diagram illustrating a display apparatus according to exemplary embodiments of the present invention.

Referring to FIG. 4, the display apparatus includes a display panel 100 and a panel driver. The panel driver includes a timing controller 201, a gate driver 301, a gamma reference voltage generator 400, a data driver 500 and a power generator 600.

The display panel 100 includes a display region for displaying an image and a peripheral region adjacent to the display region.

The display panel 100 includes a plurality of gate lines GL, a plurality of data lines DL and a plurality of sub-pixels connected to the gate lines GL and the data lines DL. The gate lines GL extend in a first direction D1 and the data lines DL extend in a second direction D2 crossing the first direction D1.

The sub-pixels include a switching element (not shown), a liquid crystal capacitor (not shown) and a storage capacitor (not shown). The liquid crystal capacitor and the storage capacitor are electrically connected to the switching element. The sub-pixels may be arranged in a matrix configuration.

The timing controller 201 receives input image data RGB and an input control signal CONT from an external device (not shown). The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 201 may generate a first control signal CONT1, a second control signal CONT2, a third control signal CONT3, a data signal DATA and a gate level shifting signal GLS based on the input image data RGB and the input control signal CONT.

The timing controller 201 may generate the first control signal CONT1 and the gate level shifting signal GLS for controlling operation of the gate driver 301 based on the input control signal CONT, and output the first control signal CONT1 and the gate level shifting signal GLS to the gate driver 300. The first control signal CONT1 may further include a vertical start signal and a gate clock signal.

The timing controller 201 may generate the second control signal CONT2 for controlling operation of the data driver 500 based on the input control signal CONT, and output the second control signal CONT2 to the data driver 500. The second control signal CONT2 may include a horizontal start signal and a load signal.

The timing controller 201 includes a data signal generator, a data storage and a data comparing part.

The data signal generator 210 may generate a data signal DATA based on the input image data RGB. The data signal generator 210 outputs the data signal DATA to the data driver 500.

The timing controller 201 may generate the third control signal CONT3 for controlling operation of the gamma reference voltage generator 400 based on the input control signal CONT, and output the third control signal CONT3 to the gamma reference voltage generator 400.

The power generator 600 outputs a power supply voltage VG to the gate driver 301. The power supply voltage VG may include a gate-on voltage and a gate-off voltage.

The gate driver 301 may generate gate signals for driving the gate lines GL in response to or based on at least one of the first control signal CONT1, the gate level shifting signal GLS received from the timing controller 201, and the power supply voltage VG received from the power generator 600. The gate driver 301 may sequentially output the gate signals to the gate lines GL.

According to aspects of the invention, the gate driver 301 may be directly mounted on the display panel 100, or may be connected to the display panel 100 as a tape carrier package (TCP) type. Alternatively, the gate driver 301 may be integrated on the peripheral region of the display panel 100.

The gamma reference voltage generator 400 may generate a gamma reference voltage VGREF in response to the third control signal CONT3 received from the timing controller 201. The gamma reference voltage generator 400 outputs the gamma reference voltage VGREF to the data driver 500. The level of the gamma reference voltage VGREF may correspond to one or more of data signals DATA.

The gamma reference voltage generator may be disposed on the timing controller 201, or may be disposed on the data driver 500.

The data driver 500 receives the second control signal CONT2 and the data signal DATA from the timing controller 201. The data driver 500 receives the gamma reference voltage VGREF from the gamma reference voltage generator 400. The data driver 500 may convert the data signal DATA to a data voltage having an analogue level by using the gamma reference voltage VGREF. The data driver 500 outputs data voltages to the data lines DL.

According to aspects of the invention, the data driver 500 may be directly mounted on the display panel 100, or may be connected to the display panel 100 as a tape carrier package (TCP) type. Alternatively, the data driver 500 may be integrated on the peripheral region of the display panel 100.

Figure 5:
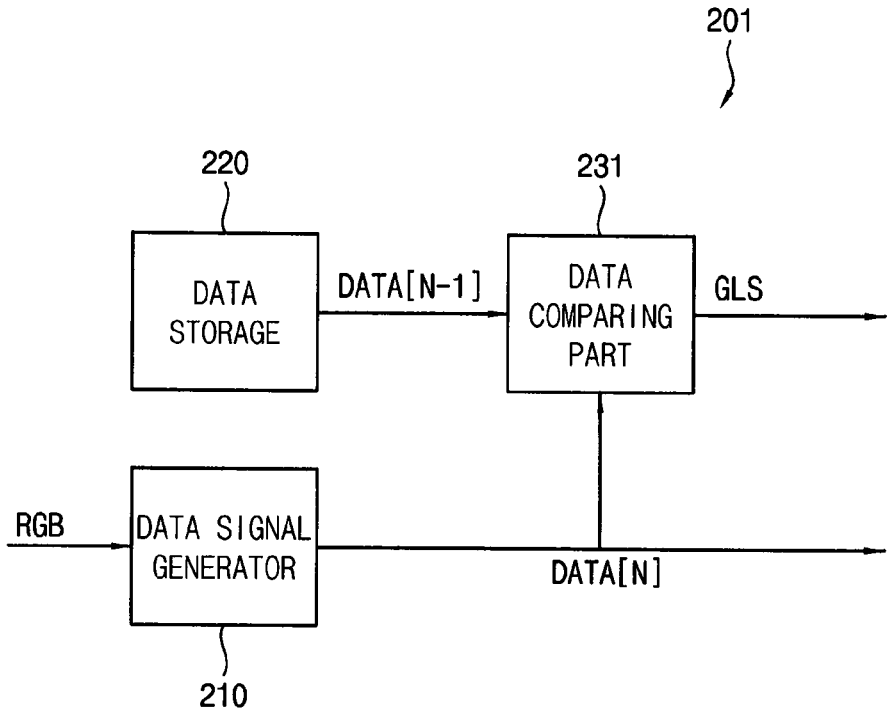
FIG. 5 is a block diagram illustrating a timing controller according to exemplary embodiments of the present invention.

FIG. 5 is a block diagram illustrating a timing controller according to exemplary embodiments of the present invention. Although the timing controller of FIG. 5 is described with respect to the display apparatus of FIG. 4 and its components, aspects of the invention are not limited thereto.

Referring to FIGS. 4 and 5, the timing controller 201 includes a data signal generator 210, a data storage 220 and a data comparing part 231.

The data signal generator 210 may generate the data signal DATA based on the input image data RGB. The data signal DATA may include previous data DATA[N−1] and present data DATA[N]. The data signal generator 210 outputs the previous data DATA[N−1] to the data storage 220. The data signal generator 210 outputs the present data DATA[N] to the data driver 500. The data signal generator 210 outputs the present data DATA[N] to the data comparing part 231.

The data storage 220 may store the previous data DATA [N−1]. The data storage 220 outputs the previous data DATA[N−1] to the data comparing part 230.

The data comparing part 231 may compare a grayscale of the previous data DATA[N−1] received from the data storage 220 with a grayscale of the present data DATA[N] received from the data signal generator 210. The data comparing part 231 may identify or determine whether the grayscale of the previous data DATA[N−1] is greater than the grayscale of the present data DATA[N]. The data comparing part 231 may measure a difference between grayscale of the previous data DATA[N−1] received from the data storage 220 and the grayscale of the present data DATA[N] received from the data signal generator 210.

The data comparing part 231 may determine a level of an adjusted gate voltage based on the difference between the grayscale of the previous data DATA[N−1] and the grayscale of the present data DATA[N]. The level of the adjusted voltage may decrease as the difference between the grayscale of the previous data DATA[N−1] and the grayscale of the present data DATA[N] increases, when the grayscale of the previous data DATA[N−1] is greater than the grayscale of the present data DATA[N].

Further, the data comparing part 231 may determine a width of the gate level shifting signal GLS based on the difference between the grayscale of the previous data DATA [N−1] and the grayscale of the present data DATA[N]. The pulse width of the gate level shifting signal GLS may increase as the difference between the grayscale of the previous data DATA[N−1] and the grayscale of the present data DATA[N] increases, when the grayscale of the previous data DATA[N−1] is greater than the grayscale of the present data DATA[N].

The data comparing part 231 may output the gate level shifting signal GLS to the gate driver 301.

Figure 6:
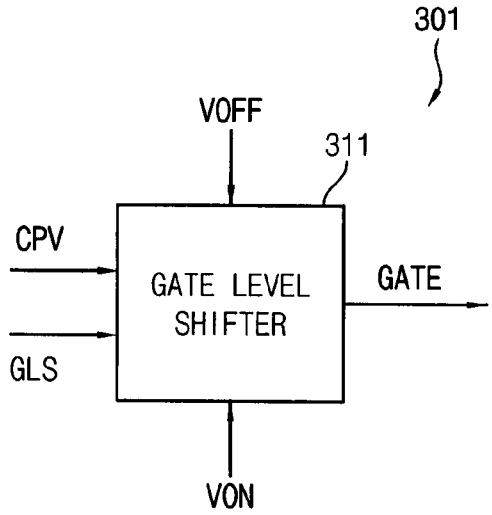
FIG. 6 is a block diagram illustrating a gate driver according to exemplary embodiments of the present invention.

FIG. 6 is a block diagram illustrating a gate driver according to exemplary embodiments of the present invention. Although the gate driver of FIG. 6 is described with respect to the display apparatus of FIG. 4 and its components, aspects of the invention are not limited thereto.

Referring to FIGS. 4, 5 and 6, the gate driver 301 includes a gate level shifter 311. The gate level shifter 311 may output a gate signal GATE based on at least one of the gate clock signal CPV, the gate level shifting signal GLS and the power supply voltage VG. The power supply voltage VG may include the gate-on voltage VON and the gate-off voltage VOFF.

The gate level shifter 311 may output the adjusted gate voltage during a first preliminary charging period. The gate level shifter 311 may output the gate-on voltage VON during a second preliminary charging period. The length of the first preliminary charging period may be substantially the same as a length of a period during which the gate level shifting signal is activated.

The adjusted gate voltage may be smaller than the gate-on voltage VON. The level of the adjusted gate voltage is a level between a level of the gate-on voltage VON and a level of the gate-off voltage VOFF (e.g., a middle level).

The data signal generator 210 may generate a data signal DATA based on the input image data RGB. The data signal DATA may include the previous data DATA[N−1] and the present data DATA[N]. The data signal generator 210 outputs the previous data DATA[N−1] to the data storage 220. The data signal generator 210 may output the present data DATA[N] to the data driver 500. The data signal generator 210 outputs the present data DATA[N] to the data comparing part 231.

The data storage 220 may store the previous data DATA [N−1]. The data storage 220 outputs the previous data DATA[N−1] to the data comparing part 231.

The data comparing part 231 may compare a grayscale of the previous data DATA[N−1] received from the data storage 220 with a grayscale of the present data DATA[N] received from the data signal generator 210. The data comparing part 231 may identify or determine whether the grayscale of the previous data DATA[N−1] is greater than the grayscale of the present data DATA[N]. The data comparing part 231 may measure a difference between grayscale of the previous data DATA[N−1] received from the data storage 220 and the grayscale of the present data DATA[N] received from the data signal generator 210.

The data comparing part 231 may determine a level of an adjusted gate voltage based on the difference between the grayscale of the previous data DATA[N−1] and the grayscale of the present data DATA[N]. The level of the adjusted voltage may be decreased as the difference between the grayscale of the previous data DATA[N−1] and the grayscale of the present data DATA[N] increases, when the grayscale of the previous data DATA[N−1] is greater than the grayscale of the present data DATA[N].

Further, the data comparing part 231 may determine a width of the gate level shifting signal GLS based on the difference between the grayscale of the previous data DATA [N−1] and the grayscale of the present data DATA[N]. The pulse width of the gate level shifting signal GLS may increase as the difference increases, when the grayscale of the previous data DATA[N−1] is greater than the grayscale of the present data DATA[N].

The gate level shifter 311 may output the adjusted gate voltage during the first preliminary charging period.

Figure 7:
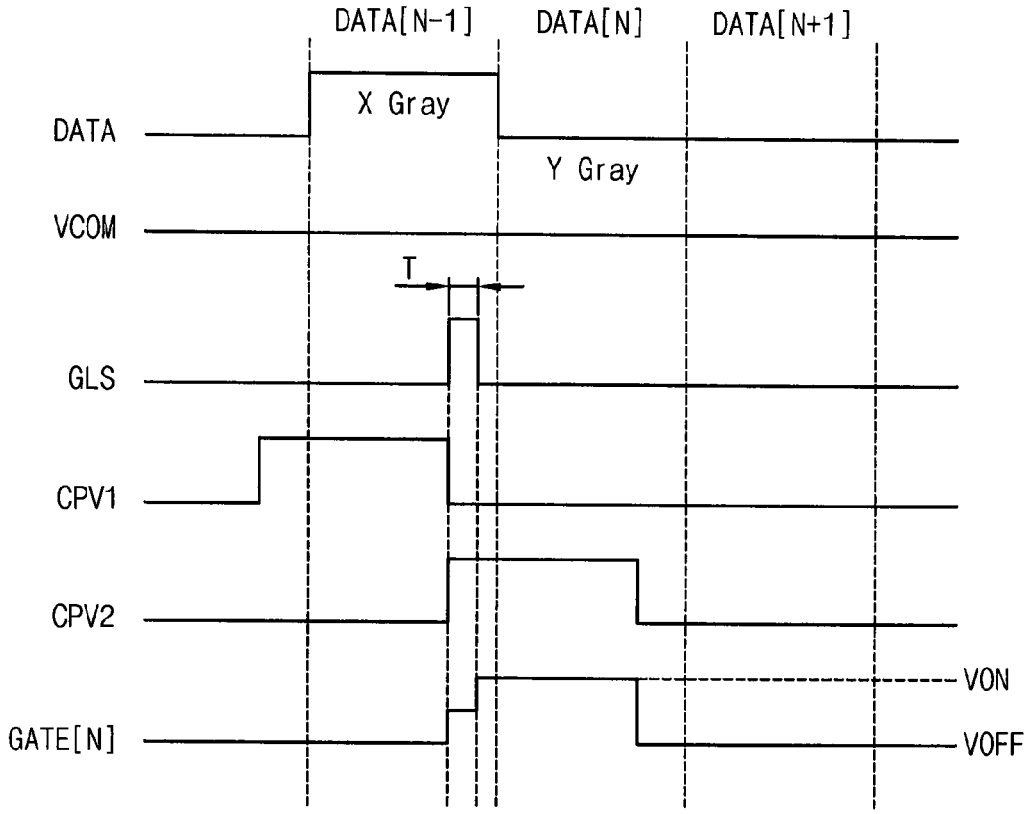
FIG. 7 is a timing diagram illustrating a data signal, a gate level shifting signal, a CPV signal and a gate signal in FIG. 4.

FIG. 7 is a timing diagram illustrating a data signal, a gate level shifting signal, a CPV signal and a gate signal in FIG. 4.

Referring to FIGS. 4, 5, 6 and 7, the data signal generator 210 may generate the previous data DATA[N−1] and the present data DATA[N] based on the input image signal RGB. The grayscale of the previous data DATA[N−1] may be a Y grayscale. The grayscale of the present data DATA[N] may be a X grayscale. The data signal generator 210 outputs the previous data DATA[N−1] to the data storage 220. The data signal generator 210 outputs the present data DATA[N] to the data comparing part 231.

The data storage 220 may store the previous data DATA [N−1]. The data storage 220 outputs the previous data DATA[N−1] to the data comparing part 231.

The data comparing part 231 may compare a grayscale of the previous data DATA[N−1] received from the data storage 220 with a grayscale of the present data DATA[N] received from the data signal generator 210. The data comparing part 231 may identify or determine whether the grayscale of the previous data DATA[N−1] is greater than the grayscale of the present data DATA[N]. The data comparing part 231 may measure a difference between grayscale of the previous data DATA[N−1] received from the data storage 220 and the grayscale of the present data DATA[N] received from the data signal generator 210.

The data comparing part 231 may determine a level of an adjusted gate voltage based on the difference between the grayscale of the previous data DATA[N−1] and the grayscale of the present data DATA[N]. The level of the adjusted voltage may be decreased as the difference increases, when the grayscale of the previous data DATA[N−1] is greater than the grayscale of the present data DATA[N].

Further, the data comparing part 231 may determine a width of the gate level shifting signal GLS based on the difference between the grayscale of the previous data DATA [N−1] and the grayscale of the present data DATA[N]. The pulse width T of the gate level shifting signal GLS may increase as the difference increases, when the grayscale of the previous data DATA[N−1] is greater than the grayscale of the present data DATA[N].

For example, the grayscale X of the previous data DATA [N−1] may be greater than the grayscale Y of the present data DATA[N]. In this case, the data comparing part 230 may measure the difference between the grayscale X and the grayscale Y. The data comparing part 231 may determine the grayscale of the level of the adjusted gate voltage based on the difference. The adjusted gate voltage may decrease as the difference increases. Further, the data comparing part 231 may determine the pulse width T of the gate level shifting signal GLS based on the difference. The pulse width T may increase as the difference increases.

The data comparing part 231 may output the gate level shifting signal GLS to the gate driver 301.

The gate driver 301 includes a gate level shifter 311. The gate level shifter 311 may output the gate signal GATE based on at least one of the gate clock signal CPV, the gate level shifting signal GLS and the power supply voltage VG. The power supply voltage VG may include the gate-on voltage VON and the gate-off voltage VOFF.

The gate level shifter 311 may output the adjusted gate voltage during the first preliminary charging period. The gate level shifter 311 may output the gate-on voltage VON during the second preliminary charging period. The length of the first preliminary charging period may be substantially similar or the same as a length of a period during which the gate level shifting signal is activated. The adjusted gate voltage may be smaller than the gate-on voltage VON. The level of the adjusted gate voltage may be a level between the level of the gate-on voltage and the level of the gate-off voltage, such as a mid-level between the level of the gate-on voltage and the level of the gate-off voltage.

For example, the grayscale X of the previous data DATA [N−1] may be greater than the grayscale Y of the present data DATA[N]. In this case, the gate level shifter 311 may output the adjusted gate voltage. The adjusted gate voltage may decrease as the difference between the grayscale X and the grayscale Y increases. The pulse width T may increase as the difference increases.

The gate level shifter 311 may output the adjusted gate voltage during the first preliminary charging period. The length of the first preliminary charging period may be substantially similar or the same as a length of the period during which the gate level shifting signal is activated. The level of the adjusted gate voltage may be smaller than the level of the gate-on voltage VON. The level of the adjusted gate voltage may be a level between the level of the gate-on voltage and the level of the gate-off voltage, such as a mid-level between the level of the gate-on voltage and the level of the gate-off voltage.

According to the exemplary embodiment, when the grayscale of the previous data is much greater than the grayscale of the present data, a ghost effect based on pre-charging method can be solved or alleviated by reducing a gate voltage during the first preliminary charging period.

According to aspects of the invention, the ghost effect due to a preliminary charging method can be solved or alleviated by comparing the grayscale of the previous data and the grayscale of the present data and compensating the grayscale of the present data or the level of the gate voltage based on the difference between the grayscale of the previous data and the grayscale of the present data. Thus, a display quality can be improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a display panel, the method comprising:

charging a pixel with first data during a first charging period;

comparing a first grayscale of the first data and a second grayscale of second data;

charging the pixel with compensated data during a second charging period if the first grayscale is greater than the second grayscale;

charging the pixel with the second data during a third charging period; and determining a third grayscale of the compensated data based on a difference between the first grayscale and the second grayscale, wherein the third grayscale is smaller than the second grayscale, if the first grayscale is greater than the second grayscale, and if the difference is greater than a reference grayscale.

2. The method of claim 1, further comprising storing the first data.

3. The method of claim 1, wherein the reference grayscale is a middle grayscale between a maximum grayscale and a minimum grayscale.

4. The method of claim 1, wherein a length of the second charging period is substantially the same as a length of the third charging period.

5. A method of driving a display panel, the method comprising:

outputting an adjusted gate voltage during a first charging period, the adjusted gate voltage having a level lower than a level of a gate-on voltage;

outputting the gate-on voltage during a second charging period;

charging a pixel with first data during the first charging period and the second charging period;

storing the first data; and determining the level of the adjusted gate voltage based on a difference between a grayscale of the first data and a grayscale of second data.

6. The method of claim 5, wherein the level of the adjusted gate voltage decreases as the difference increases if the grayscale of the first data is greater than the grayscale of the second data.

7. The method of claim 5, wherein the level of the adjusted gate voltage is a middle level between the level of the gate-on voltage and a level of a gate-off voltage.

8. The method of claim 5, further comprising:

storing the first data; and determining a pulse width of a gate level shifting signal based on a difference between a grayscale of the first data and a grayscale of a second data, wherein a length of the first charging period is substantially the same as a length of a period during which the gate level shifting signal is activated.

9. The method of claim 8, wherein the pulse width of the gate level shifting signal increases as the difference increases if the grayscale of the first data is greater than the grayscale of the second data.

10. A display apparatus, comprising:

a display panel configured to display an image;

a gate driver configured to output a gate-on voltage during a first charging period; and a data driver configured to output a data voltage of compensated data to a pixel during a second charging period if a first grayscale of first data is greater than a second grayscale of second data, and to output a data voltage of the second data to the pixel during a third charging period, wherein the timing controller is further configured to set the grayscale of the compensated data smaller than the second grayscale, if the first grayscale is greater than the second grayscale, and if the difference is greater than a reference grayscale.

11. The display apparatus of claim 10, further comprising:

a data storage configured to store the first data; and a timing controller configured to determine a grayscale of the compensated data based on a difference between the first grayscale and the second grayscale.

12. The display apparatus of claim 10, wherein a length of the second charging period is substantially the same as a length of the third charging period.

13. A display apparatus, comprising:

a display panel configured to display an image;

a gate driver configured to output an adjusted gate voltage having a level lower than a level of a gate-on voltage during a first charging period, and to output the gate-on voltage during a second charging period;

a data driver configured to output a data voltage of previous data to a pixel during the first charging period and the second charging period;

a data storage configured to store the previous data; and a timing controller configured to determine the level of the adjusted gate voltage based on a difference between a gray scale of the previous data and a gray scale of present data.

14. The display apparatus of claim 13, wherein the level of the adjusted gate voltage is a middle level between the level of the gate-on voltage and a level of a gate-off voltage.

15. The display apparatus of claim 13, further comprising:

a data storage configured to store the previous data; and a timing controller configured to determine a pulse width of a gate level shifting signal based on a difference of a grayscale of the previous data and a grayscale of present data, wherein a length of the first charging period is substantially the same as a length of a period during which the gate level shifting signal is activated.

* * * * *